United States Patent [19]

Sainato

[11] Patent Number: 4,854,533

[45] **Date of Patent: * Aug. 8, 1989**

[54] ASSEMBLY FOR MOUNTING A DISPLAY SIGN

[75] Inventor: Anthony V. Sainato, Glenview, Ill.

[73] Assignee: Creative Products Merchandising, Inc., Elk Grove Village, Ill.

[ * ] Notice: The portion of the term of this patent subsequent to Jan. 17, 2006 has been disclaimed.

[21] Appl. No.: 118,770

[22] Filed: Nov. 9, 1987

[51] Int. Cl.[4] ..... E04G 5/06

[52] U.S. Cl. ..... 248/221.1; 248/201

[58] Field of Search ..... 248/221.1, 220.4, 221.2, 248/220.3, 201, 219.2, 219.3, 558, 220.2; 40/649, 651

[56] References Cited

U.S. PATENT DOCUMENTS

| | | | |
|---|---|---|---|
| 2,174,068 | 9/1939 | Citron | 40/490 |
| 4,212,445 | 7/1980 | Hagen | 248/221.1 X |
| 4,303,217 | 12/1981 | Garfinkle | 248/221.1 |
| 4,319,731 | 3/1982 | Pfeifer | 248/223.4 |
| 4,344,244 | 8/1982 | Tyke | 40/611 |
| 4,474,351 | 10/1984 | Thalenfeld | 248/220.4 |
| 4,665,639 | 5/1987 | Fast | 248/220.4 X |
| 4,750,698 | 6/1988 | Barnes | 248/220.4 |

*Primary Examiner*—Ramon O. Ramirez

*Attorney, Agent, or Firm*—Tarolli, Sundheim & Covell

[57] ABSTRACT

The present invention is a mounting assembly for mounting aw display sign on either a vertical support or a horizontal support as part of a product display. The mounting assembly includes a sign holder, a brace for supporting the sign holder, and a universal attachment bracket for attachng the brace to either the vertical or the horizontal support. The bracket allows the brace to be attached at varying angles to the horizontal support (such as a shef), and also allows the brace to be attached at different horizontal distances from the vertical support (such as a pegboard). The sign holder may be attached at varying angles relative to the brace.

17 Claims, 5 Drawing Sheets

ASSEMBLY FOR MOUNTING A DISPLAY SIGN

BACKGROUND OF THE INVENTION

1. Field of the Invention

The present invention relates to an assembly for mounting a display sign and, in particular, an assembly for mounting a display sign on a vertical support panel or a horizontal support panel.

2. Description of the Prior Art

A product display may comprise a vertical support, such as a pegboard, or a horizontal support, such as a shelf, or both. Product displays are often accompanied by display signs containing product related information. Generally, a display sign is mounted on the vertical support or the horizontal support by means of a mounting assembly. The mounting assembly includes a sign holder and some type of bracket for attaching the sign holder to the vertical support or the horizontal support. Representative known mounting assemblies are shown in U.S. Pat. Nos. 2,174,068; 4,319,731; and 4,344,244.

A significant improvement in display sign mounting assemblies is achieved by mounting assemblies described in pending U.S. application Ser. No. 886,090 assigned to the assignee of the present application. However, the mounting assemblies described in U.S. application Ser. No. 886,090 are not universal. Specifically, they can be used only with either a horizontal support or a vertical support, and they do not allow a high degree of flexibility in the angular orientation of the display sign relative to the support.

SUMMARY OF THE INVENTION

The present invention is a universal mounting assembly for mounting a display sign on either or both of a vertical support and a horizontal support. The mounting assembly according to the present invention provides for a high degree of flexibility in the angular orientation of the display sign relative to both the vertical support and the horizontal support on which the display sign is mounted.

A mounting assembly according to the present invention includes a sign holder for holding a display sign, a brace for supporting the sign holder, and a universal attachment bracket that permits attachment of the brace either to the vertical support or to the horizontal support. The attachment bracket provides for detachable attachment of the brace to the support. The brace has opposite ends and a middle portion extending therebetween. The sign holder is attached to one end of the brace. The attachment bracket is used to connect the other end of the brace to the horizontal support or the vertical support. The attachment bracket may also be used to connect the middle portion of the brace to the vertical support.

The attachment bracket includes two substantially mutually perpendicular plates. The first plate lies against and is attached to a support panel by fastener means. The second plate lies against and is attached to the brace by other fastener means. The second plate has a first opening located adjacent a common edge of the two plates and a plurality of second openings located farther away from the common edge of the two plates. The brace has a pair of vertically spaced holes at the other end thereof. The pair of vertically spaced holes in the brace cooperate with the first opening and one of the plurality of second openings in the attachment bracket, for attaching the brace to the horizontal support. Providing a plurality of second openings allows the brace to be attached to the horizontal support, via the attachment bracket, at different angles relative to the horizontal support.

The first plate of the attachment bracket has a plurality of parallel rows of third openings. A pair of these third openings and the pair of vertically spaced holes at an end of the brace provide for attaching the brace to the vertical suport at that end of the brace. The brace has another pair of vertically spaced holes formed in the middle portion of the brace for cooperating with a pair of third openings on the attachment bracket, in order to attach the middle portion of the brace to the vertical support. Providing a plurality of parallel rows of pairs of openings allows the brace to be attached to the vertical support at different horizontal distances from the vertical support.

The plate of the attachment bracket which lies against a support includes at least two openings. A pair of fasteners insertable into the two openings secures the attachment bracket to the support. Generally, two attachment brackets, attached on opposite sides of the brace, are used to attach the brace to a support.

BRIEF DESCRIPTION OF THE DRAWINGS

The objects, advantages and features of the present invention will become evident to those skilled in the art to which the present invention pertains from reading the following specification with reference to the accompanying drawings, wherein.

DESCRIPTION OF A PREFERRED EMBODIMENT

Figure 1:
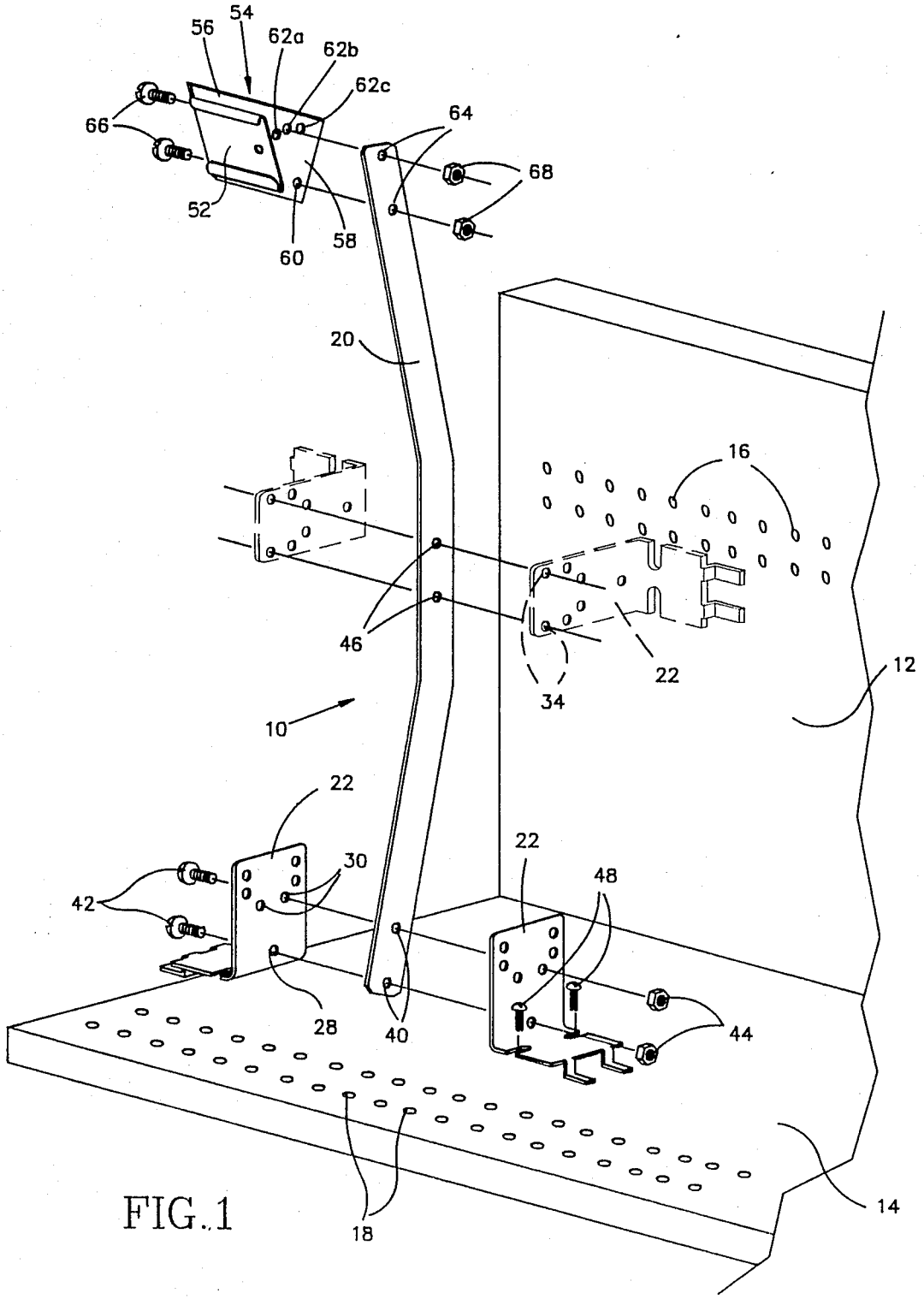
FIG. 1 is an exploded view of a portion of a merchandising display including a sign mounting assembly according to the present invention.

FIG. 1 shows an assembly 10 according to the present invention for mounting a display sign on a product display. The product display shown in FIG. 1 includes a generally vertical pegboard support panel 12 and a generally horizontal shelf 14. The vertical support panel 12 has a series of perforations 16 formed therein in columns and rows. The horizontal shelf 14 has a series of perforations 18 formed therein in columns and rows. While the product display shown in FIG. 1 includes a vertical support panel and a horizontal shelf, a product display on which the present invention is used may include only a vertical support panel or only a horizontal support panel.

Figure 4:
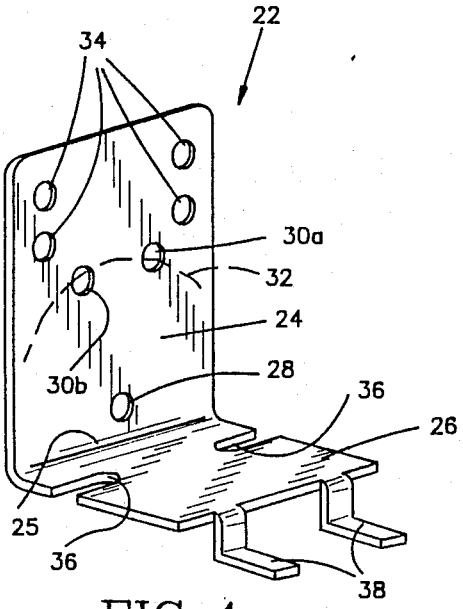
FIG. 4 is a perspective view of an attachment bracket according to the present invention.

The sign holder mounting assembly according to the present invention includes a mounting brace 20 and at least one and preferably a pair of substantially identical attachment brackets 22 for attaching the brace 20 to either the horizontal support 14 or the vertical support panel 12. FIG. 4 shows that each attachment bracket 22 comprises two mutually perpendicular plates 24 and 26 joined at an edge 25. The first plate 24 is adapted to be attached to the brace 20, and the second plate 26 is adapted to be attached to the horizontal support panel 14 or to the vertical support panel 12 as needed.

First plate 24 (FIG. 4) of bracket 22 includes a first opening 28 adjacent the edge 25. Plate 24 also includes a plurality of second openings 30*a* and 30*b*. The centers of the openings 30 lie on an arc 32 of an imaginary circle having its center in the center of the opening 28. Adjacent the edge of the plate 24 which is opposite to the common edge 25, there are two rows of third openings 34. The distance between centers of the openings 34 in each row is equal to the radius of the circle 32. While two rows of openings 34 are shown, it is clear that a different number of rows can be provided. All openings in the plate 24 are substantially the same size.

The second plate 26 of each bracket 22 has two slots 36 for receiving fixing screws used to attach bracket 22 to a support panel. The plate 26 also includes leg portions 38 for aligning the attachment brackets 22 with the support panel. The leg portions are configured to be inserted into respective perforations 16 or 18 of the pegboard panel 12 or the shelf 14 for installing the attachment bracket 22 in the pegboard panel 12 or shelf 14. When this is done, slots 36 will line up with other perforations in the panel to receive the fixing screws therethrough.

In order to attach the brace 20 (FIG. 1) to the brackets 22, the first opening 28 and one of the second openings 30, of each attachment bracket 22, cooperate with two openings 40 provided at one end of the brace (the lower end as seen in FIG. 1). Providing a plurality of second openings 30 allows the brace 20 to be attached to the horizontal support panel 14 at different angular positions of the brace 20 with respect to the horizontal support panel 14. While only two second openings 30 are shown, it is clear that a different number of openings can be provided. Two screws 42 and two nuts 44 are used for connecting the two brackets 22 with the brace 20. Other types of fasteners may also be used.

To connect the middle portion of the brace 20 (FIG. 1) to the vertical support panel 12, one row of third openings 34 in the bracket 22 cooperates with a pair of openings 46 in the middle portion of the brace 20. Screws and nuts (not shown) connect the two. To connect the end portion of the brace 20 (FIG. 7*g*) to the vertical support panel 12, one row of third openings 34 in the bracket 22 cooperates with a pair of openings 40 in the end portion of the brace 20. Screws and nuts (not shown) connect them. Providing several rows of openings 34 allows the brace 20 to be attached, at either its middle portion (FIG. 1) or its end portion (FIG. 7*g*), to the vertical support panel at different horizontal distances from the vertical support panel. While only two rows of openings 34 are shown, it is clear that more than two rows may be provided if desired.

The brace 20 is shown in FIG. 1 as being connected to a support panel by two attachment brackets 22. However, the brace 20 may also be connected to a support panel with only one bracket 22.

Figure 2:
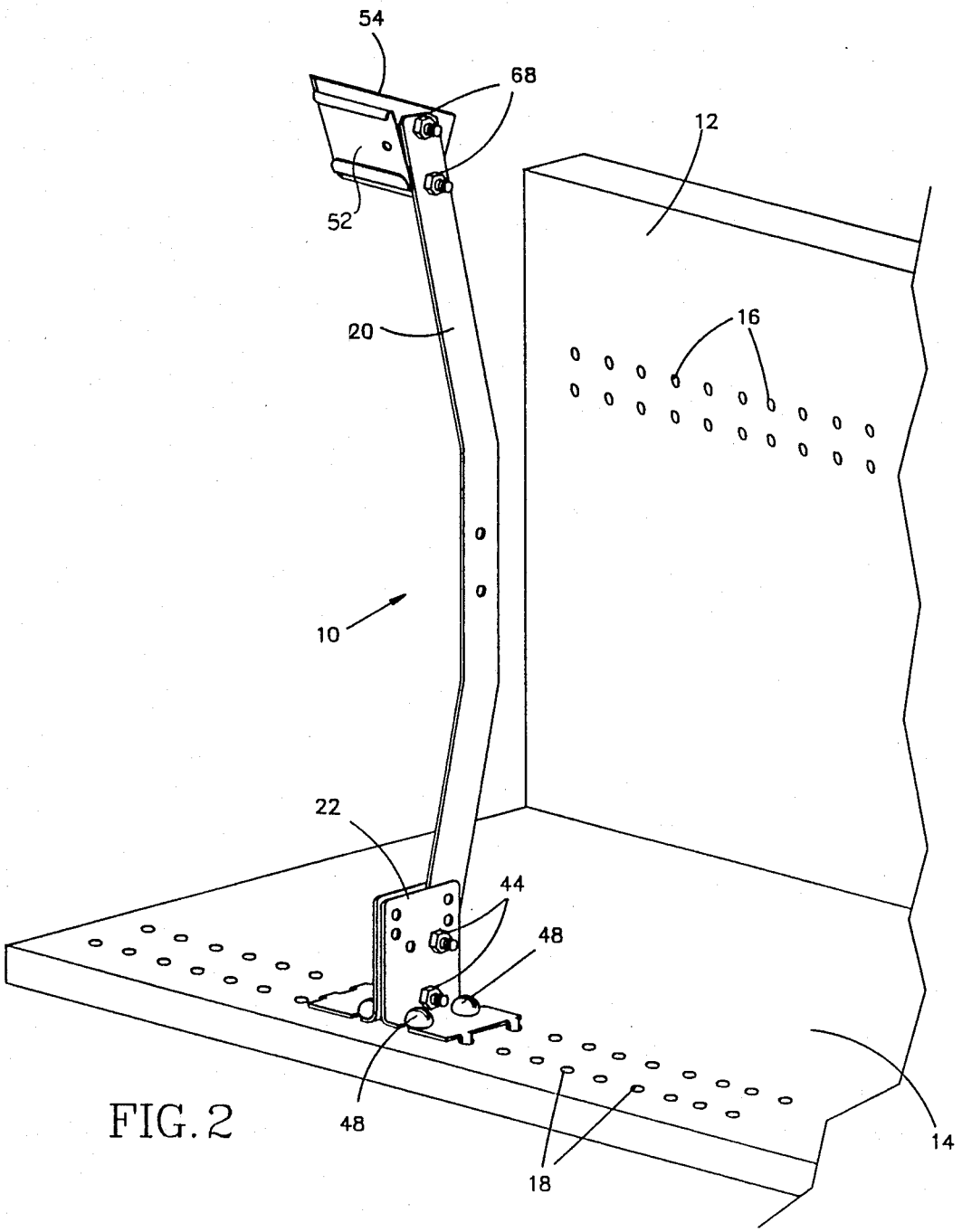
FIG. 2 is a perspective view of a portion of a merchandising display in which the brace for supporting the sign holder is attached to a horizontal support.
Figure 3:
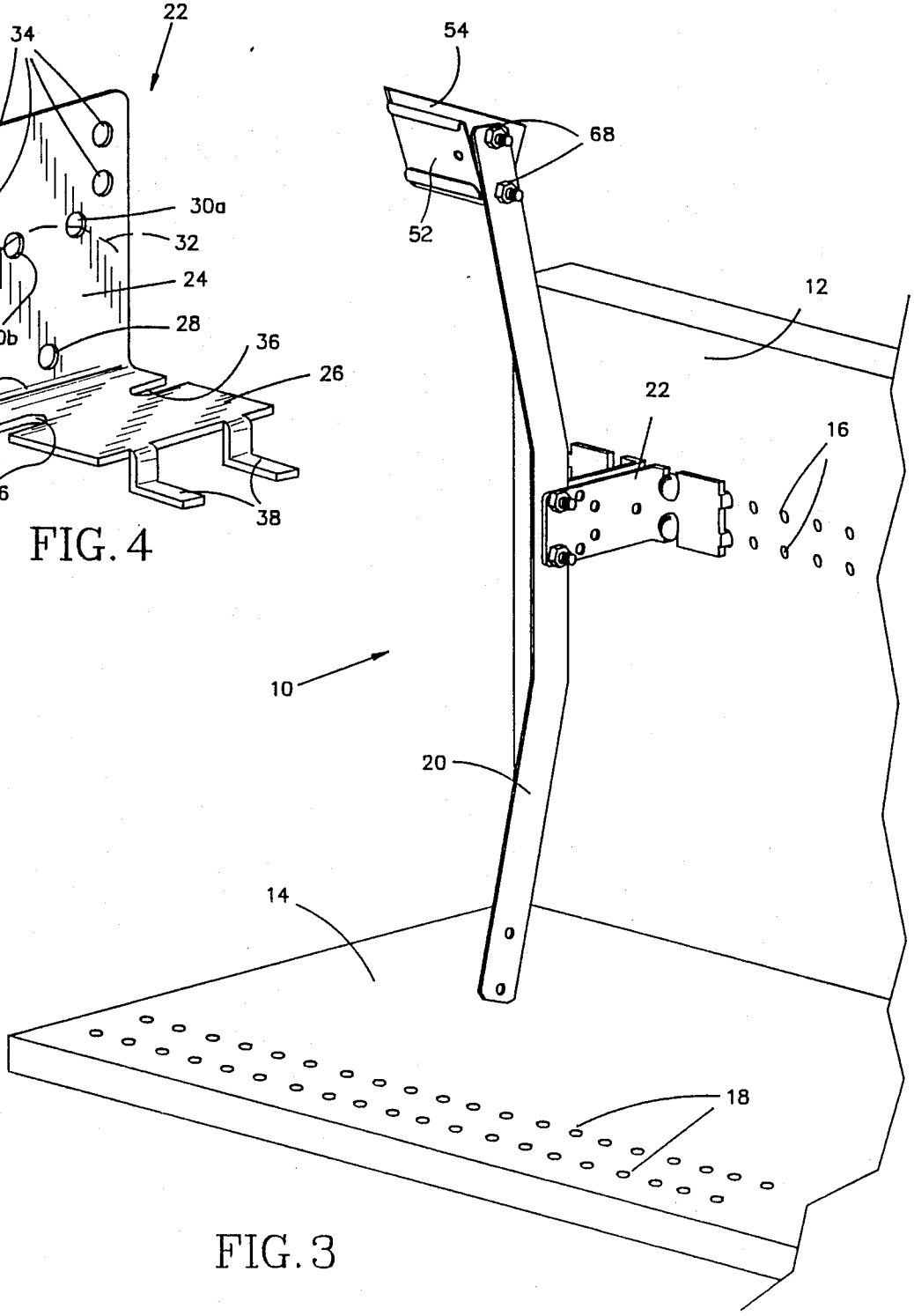
FIG. 3 is a perspective view of a portion of a merchandising display in which the brace for supporting the sign holder is, attached to a vertical support.
Figure 5:
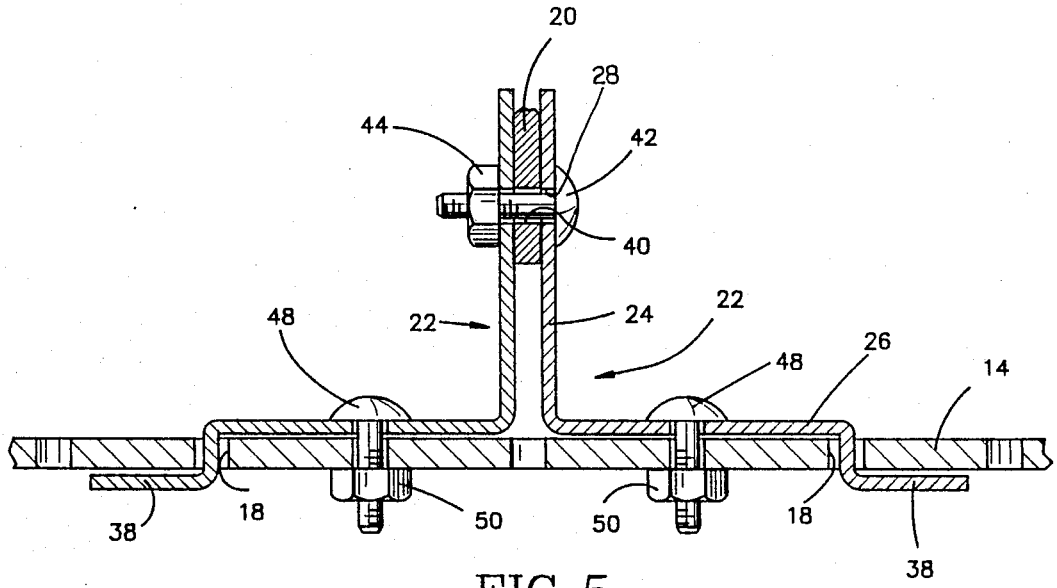
FIG. 5 is a partial cross-sectional view of the merchandising display shown in FIG. 2.

FIG. 5 illustrates in more detail how brace 20 is attached to the horizontal support panel 14. A pair of brackets 22 are connected to the horizontal support panel 14 by pairs of screws 48 cooperating with nuts 50, thus fixing the brackets 22 to the horizontal support panel 14. Legs 38 in the brackets 22 extend through openings 18 in the panel 14 to align brackets 22. Brace 20 is secured to brackets 22 by screw 42 and nut 44 extending through openings 40 and 28 in the brace and bracket, respectively. The brace 20 and brackets 22 can be attached to the vertical support panel in a similar manner. FIGS. 2 and 3 show, respectively, the brace 20 attached to the horizontal support panel 14 and to the vertical support panel 12.

A sign holder 52 (FIG. 1) is connected to an end of the brace 20. The sign holder 52 is designed to hold a display sign 84 (see FIG. 6). The sign holder 52 (FIG. 1) is connected to a support bracket 54 connectable with the brace 20. The support bracket 54 has an L-shaped form, one leg 56 of which carries the sign holder 52, and the other leg 58 of which is connectable with the brace 20. The leg 58 is provided with a first opening 60 and a plurality of second openings 62*a*, 62*b*, 62*c* lying on an arc of a circle having its center in the center of opening 60. The opening 60 and one of the openings 62 cooperate with a pair of openings 64 provided in the brace 20 for attaching the support bracket 54 to the brace 20. The support bracket 54 is attached to the brace 20 by pairs of screws 66 and nuts 68. Providing a plurality of second openings 62 allows the support bracket 54 and accordingly the sign holder 52 to be attached to the brace 20 at different angular positions relative to the brace 20.

Figure 6:
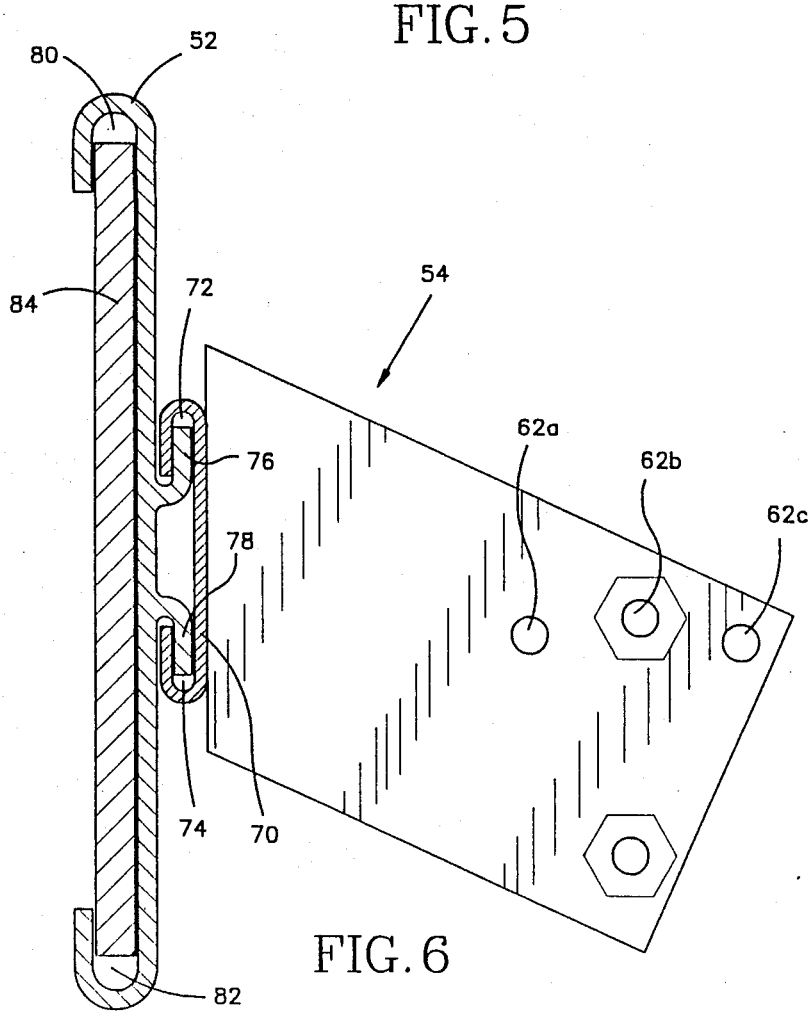
FIG. 6 is a partial cross-sectional view showing the mounting of a sign holder on a support bracket.

The specific connection of the sign holder 52 with the support bracket 54 is shown in FIG. 6. The support bracket 54 for supporting the sign holder 52 includes a plate 70 with a pair of spaced opposite upper and lower tracks 72, 74. The tracks 72, 74 are adapted to slidably interfit with opposite complementary rear upper and lower projections 76 and 78 on the sign holder 52 for supporting the sign holder 52. The front surface of the sign holder 52 is provided with a pair of spaced opposite upper and lower tracks 80 and 82 for slidably receiving a display sign 84. The plate 70 may be connected to the leg 56 of the support bracket by welding or any other appropriate means.

FIGS. 7*a*–7*g* show schematically some of the possible mountings of the supporting brace on the horizontal or vertical support panels (not shown), and also the possible angular attachments of the sign holder 52 to the brace 20.

Figure 7A:
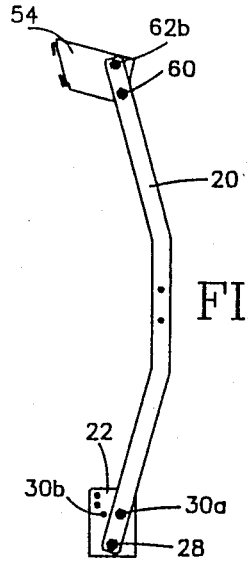
FIGS. 7A–7G are schematic views showing mounting of the supporting brace and the support bracket in different angular positions.
Figure 7D:
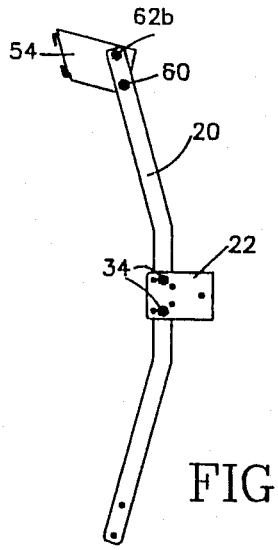
Figure 7B:
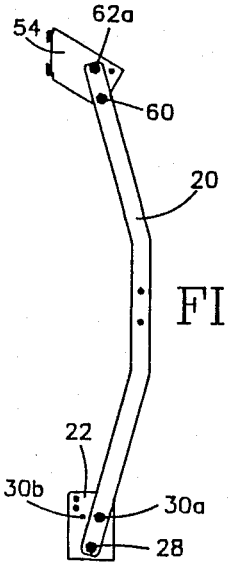
Figure 7E:
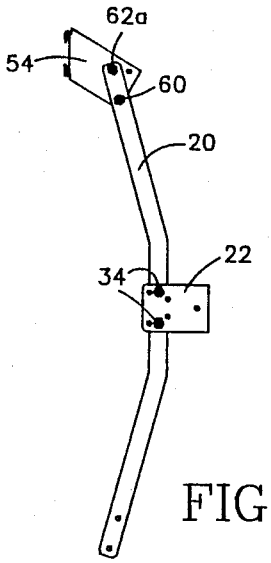
Figure 7G:
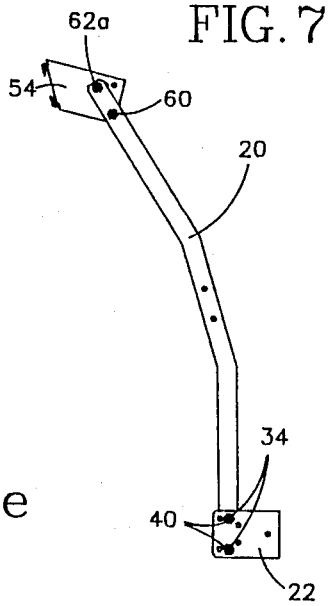
Figure 7C:
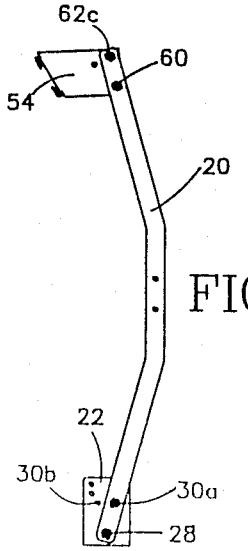

FIGS. 7*a*–7*c* show schematically three different angular mounting positions of the sign holder support bracket 54 and thereby the sign holder 52 with respect to the horizontal support panel 14 (not shown). The three positions are obtained by connecting the support bracket 54 to the brace 20 by using the opening 60 and the three different openings 62*a*, 62*b*, 62*c* in the bracket 54. Screws are inserted into the opening 60 and one of openings 62*a*, 62*b*, 62*c* (in the bracket) and through the holes 64 (in the brace), and nuts are threaded on the screws to secure the bracket 54 to the brace 20. The brace 20 is attached at its other end to the horizontal support panel 14 by means of the attachment bracket 22 by using openings 28 and 30*a*. If, instead, openings 28 and 30*b* are used for attaching the brace 20 to the horizontal support panel 14, then three additional angular positions of the brace and thereby the sign holder 52 relative to the horizontal support panel can be obtained.

Figure 7F:
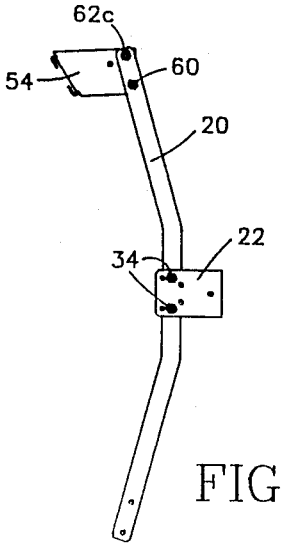

FIGS. 7*d*–7*f* show three different angular positions of the sign holder support bracket 54 relative to the vertical support panel 16 (not shown). As in FIGS. 7*a*–7*c*, the three different angular positions of the sign holder support bracket 54 relative to the vertical support panel 12 are obtained by mounting the bracket 54 on the brace 20 using the opening 60 and one of the three openings 62*a*, 62*b*, 62*c* in the support bracket 54. In FIGS. *7d–7f*, the brace 20 is attached to the vertical support panel 12 at a first horizontal distance therefrom by using the second row of openings 34 in the plate 24 of the attachment bracket 22. The brace 22 may be attached to the horizontal support panel 12 at a second horizontal distance therefrom if the first row of openings 34 is used.

FIG. *7g* shows attachment of the brace 20 at its lower end thereof to the vertical support panel 12. As in FIGS. *7d–7f*, the support bracket 54 can be attached at three different angular positions relative to the vertical support panel 12 and at two different horizontal distances therefrom.

Thus, FIGS. 1 and 7 show that the brace 20 may, in effect, be connected to the support 14 or the support 16 at different angular positions about an imaginary first axis which extends transverse to the plane of the brace 20 and parallel to the plane of the support 14 or the support 16. Similarly, the sign holder 52 may be connected to the brace 20 at different angular positions about an imaginary second axis which extends parallel to the first axis.

While particular embodiments have been shown and described, various modifications thereof will be apparent to those skilled in the art and, therefore, it is not intended that the invention be limited to the disclosed embodiments or details thereof, and departures may be made therefrom within the spirit and scope of the invention as defined in the appended claims.

I claim:

1. An assembly, for mounting a display sign on a vertical support panel or a horizontal support panel, said assembly comprising:

a sign holder for holding the display sign;

a brace for supporting said sign holder; and an attachment bracket for detachably attaching said brace to a support panel;

said brace having first and second opposite ends and an intermediate portion extending between said first and second opposite ends, said sign holder being connectable with one of said first and second opposite ends;

said attachment bracket having first means connectable with the other of said first and second opposite ends of said brace for attaching said brace to the horizontal support panel, and said attachment bracket having second means connectable with the other of said first and second opposite ends of said brace or said intermediate portion for attaching said brace to the vertical support panel.

2. An assembly as set forth in claim 1 further comprising a support bracket for detachably connecting said sign holder to said brace.

3. An assembly as set forth in claim 1 wherein said first means is adjustably connectable with said other of said first and second ends of said brace for attaching said brace to the horizontal support panel at different angular positions of said brace with respect to the horizontal support panel to thereby vary the position of the sign holder relative to the horizontal support panel.

4. An assembly as set forth in claim 1 comprising a pair of attachment brackets.

5. An assembly as set forth in claim 1 wherein said attachment bracket comprises a pair of substantially mutually perpendicular, plates, one of said pair of plates lying against the support panel and the other of said pair of plates lying against said brace.

6. An assembly as set forth in claim 5 wherein said first means comprises a first opening provided in said other plate and located adjacent a common edge of said pair of plates and at least one second opening in said other plate and located farther away from the common edge of said pair of plates, the other of said first and second ends of said brace having a first pair of vertically spaced holes cooperating with said first and at least one second openings, and wherein said second means comprises a first pair of third openings provided in said other plate and located adjacent the opposite edge of said other plate that extends parallel to the common edge of said pair of plates, said third openings cooperating with said first pair of vertically spaced holes on said other brace or a second pair of vertically spaced holes provided on said intermediate portion of said brace for attaching said brace to the vertical support panel.

7. An assembly as set forth in claim 6 wherein said first means comprises a plurality of second openings for attaching said brace to the horizontal support panel at different angular positions thereof with respect to the horizontal support panel to thereby vary the position of the sign holder relative to the horizontal support panel.

8. An assembly as set forth in claim 7 wherein said second means comprises a second pair of third openings located adjacent said first pair of third openings for enabling attachment of said brace to the vertical support panel at different horizontal distances from the vertical support panel.

9. An assembly as set forth in claim 8 wherein said one plate has at least two openings therein, and said assembly further comprises a pair of first fasteners insertable into said first opening and any of said second openings or into any pair of said pairs of third and fourth openings for securing said attachment bracket to said brace, and a pair of second fasteners insertable into said two openings in said one plate for securing said attachment bracket to the horizontal support panel or the vertical support panel.

10. An assembly for mounting a display sign on a vertical support panel or a horizontal support panel, said assembly comprising:

a sign holder for holding the display sign;

a brace for supporting said sign holder; and an attachment bracket for detachably attaching said brace to a support panel;

said attachment bracket comprising first means for enabling attachment of said brace to a horizontal support panel at different angular positions of said brace with respect to the horizontal support panel to thereby vary the position of the sign holder relative to the horizontal support panel and second means for enabling attachment of said brace to a vertical support panel at different horizontal distances from the vertical support panel.

11. An assembly as set forth in claim 10 comprising two attachment brackets.

12. An assembly as set forth in claim 10 comprising a support bracket for adjustably detachably connecting said sign holder to said brace to thereby vary the angular position of said sign holder relative to said brace.

13. An assembly for mounting a display sign on a vertical support panel or a horizontal support panel, said assembly comprising:

a sign holder for holding the display sign;

a brace for supporting said sign holder; and an attachment bracket for detachably attaching said brace to a support panel;

said attachment bracket comprising first means for enabling attachment of said brace to a horizontal support panel at different angular positions of said brace with respect to the horizontal support panel to thereby vary the position of the sign holder relative to the horizontal support panel and second means for enabling attachment of said brace to a vertical support panel at different horizontal distances from the vertical support panel;

said attachment bracket comprising a pair of substantially mutually perpendicular plates, one of said pair of plates lying against the support panel and the other of said pair of plates lying against said brace, said first means comprising a first opening provided in said other plate and located adjacent a common edge of said pair of plates and a plurality of second openings in said other plate and located farther away from the common edge of said pair of plates, said second means comprising a pair of third openings provided in said other plate and located adjacent the edge of said other plate that extends parallel to the common edge of said pair of plates, and a pair of fourth openings in said other plate located adjacent said third openings, said brace having a pair of vertically spaced holes cooperating with said first and one of said second openings when said brace is attached to the horizontal support panel, and cooperating with one of said pair of third openings or pair of fourth openings when said brace is attached to the vertical support panel.

14. An assembly as set forth in claim 13 wherein said one plate has at least two openings therein, and said assembly further comprises a pair of first fasteners insertable into said first opening and said one second opening or into any pair of said pairs of third and fourth openings for securing said attachment bracket to said brace, and a pair of second fasteners insertable into said two openings in said one plate for securing said attachment bracket to the horizontal support panel or the vertical support panel.

15. An assembly for mounting a sign on a horizontal support, said assembly comprising:

a sign holder for holding a display sign;

a brace for supporting said sign holder;

a support bracket for detachably connecting said sign holder to said brace at one end thereof;

an attachment bracket detachably connected with said brace at the other end of said brace for attaching said brace to the support; and said attachment bracket comprising first means for connecting said brace to said attachment bracket at different angular positions of said brace with respect to the support about a first axis extending transverse to the plane of said brace and parallel to the plane of the support, and said support bracket comprising means for connecting said sign holder to said brace at different angular positions relative to said brace about a second axis extending parallel to the first axis.

16. An assembly for mounting a sign on a horizontal support, said assembly comprising:

a sign holder for holding a display sign;

a brace for supporting said sign holder;

a support bracket for detachably connecting said sign holder to said brace at one end thereof;

an attachment bracket detachably connected with said brace at the other end of said brace for attaching said brace to the support; and said attachment bracket comprising first means for connecting said brace to said attachment bracket at different angular positions of said brace with respect to the support about a first axis extending transverse to the plane of said brace and parallel to the plane of the support, and said support bracket comprising means for connecting said sign holder to said brace at different angular positions relative to said brace about a second axis extending parallel to the first axis;

said attachment bracket comprises a vertical plate, said first means including a first opening at the lower end of said vertical plate and a plurality of second openings vertically spaced from said first opening, said support bracket comprises a vertically extending side plate, and said means on said support bracket for connecting said sign holder to said brace comprising means defining a plurality of openings therein, said brace having a first pair of openings at the lower end thereof cooperating with said first opening and one of said second openings in said vertical plate of said attachment bracket for adjustable attachment therewith and a second pair of openings at the upper end thereof cooperating with two of said plurality of openings in said vertically extending side plate of said support bracket for adjustable connection therewith.

17. An assembly as set forth in claim 16 wherein said attachment bracket comprises a horizontal plate having two slots therein, and said assembly further comprises a plurality of fasteners for securing said attachment and support brackets to said brace and for securing said attachment bracket to the shelf.

* * * * *